US009033044B2

(12) United States Patent
Huang

(10) Patent No.: US 9,033,044 B2
(45) Date of Patent: May 19, 2015

(54) METHOD AND MATERIALS FOR PROPPANT FRACTURING WITH TELESCOPING FLOW CONDUIT TECHNOLOGY

(75) Inventor: Tianping Huang, Spring, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 491 days.

(21) Appl. No.: 12/723,983

(22) Filed: Mar. 15, 2010

(65) Prior Publication Data

US 2011/0220361 A1 Sep. 15, 2011

(51) Int. Cl.

| | |
|---|---|
| ***E21B 43/26*** | (2006.01) |
| ***E21B 23/04*** | (2006.01) |
| ***E21B 43/267*** | (2006.01) |
| ***E21B 34/06*** | (2006.01) |

(52) U.S. Cl.
CPC ..... *E21B 43/267* (2013.01); *E21B 34/063* (2013.01)

(58) Field of Classification Search
CPC ..... E21B 23/04; E21B 34/063; E21B 34/10; E21B 43/26; E21B 43/283
USPC ..... 166/311, 205, 300, 317, 376
See application file for complete search history.

(56) References Cited

U.S. PATENT DOCUMENTS

| | | | | |
|---|---|---|---|---|
| 5,224,556 | A * | 7/1993 | Wilson et al. | 175/4.53 |
| 6,805,198 | B2 | 10/2004 | Huang et al. | |
| 7,461,699 | B2 | 12/2008 | Richard et al. | |
| 7,527,103 | B2 | 5/2009 | Huang et al. | |
| 7,604,055 | B2 | 10/2009 | Richard et al. | |
| 2006/0113077 | A1 | 6/2006 | Willberg et al. | |
| 2008/0035349 | A1 * | 2/2008 | Richard | 166/308.1 |
| 2008/0289823 | A1 | 11/2008 | Willberg et al. | |
| 2008/0296024 | A1 * | 12/2008 | Huang et al. | 166/311 |

FOREIGN PATENT DOCUMENTS

| | | |
|---|---|---|
| CN | 1047326 A | 11/1990 |
| CN | 1882759 A | 12/2006 |

OTHER PUBLICATIONS

R. Weinberger, et al., "Tensile Properties of Rocks in Four-Point Beam Tests Under Confining Pressure," Rock Mechanics, 1994, pp. 435-442.

T. Huang, et al., "Reaction Rate and Fluid Loss: The Keys to Wormhole Initiation and Propagation in Carbonate Acidizing," SPE 65400, SPE International Symposium on Oilfield Chemistry, Feb. 18-21, 1997, vol. 5, No. 3, pp. 287-292.

O. Katz, et al., "Evaluation of Mechanical Rock Properties Using a Schmidt Hammer," International Journal of Rock Mechanics and Mining Science, 2000, vol. 37, pp. 723-728.

T. Huang, et al., "Carbonate Matrix Acidizing Fluids at High Temperatures: Acetic Acid, Chelating Agents or Long-Chained Carboxylic Acids," SPE 82268, SPE European Formation Damage Conference, The Hague, The Netherlands, May 13-14, 2003.

* cited by examiner

*Primary Examiner* — Catherine Loikith
(74) *Attorney, Agent, or Firm* — Mossman Kumar & Tyler PC

(57) ABSTRACT

Acid-soluble plugs may be employed within telescoping devices to connect a reservoir face to a production liner without perforating. Such technology eliminates formation damage and debris removal associated with perforating, as well as reducing risk and time. The plugs may provide enough resistance to enable the telescoping devices to extend out from the production liner under hydraulic pressure. The plugs may then be dissolved in an acidic solution, which may also be used as the hydraulic extension fluid. After the plugs are substantially removed from the telescoping devices, the reservoir may be hydraulically fractured using standard fracturing processes.

11 Claims, 3 Drawing Sheets

METHOD AND MATERIALS FOR PROPPANT FRACTURING WITH TELESCOPING FLOW CONDUIT TECHNOLOGY

TECHNICAL FIELD

The present invention relates to methods and compositions for temporarily blocking a flow pathway, and more particularly relates, in one embodiment, to methods and compositions for temporarily blocking a flow pathway to subterranean formations during hydrocarbon recovery operations.

BACKGROUND

There are a number of procedures and applications that involve the formation of a temporary seal or plug while other steps or processes are performed, where the seal or plug must be later removed. Often such seals or plugs are provided to temporarily block a flow pathway or inhibit the movement of fluids or other materials, such as flowable particulates, in a particular direction for a short period of time, when later movement or flow is desirable.

The recovery of hydrocarbons from subterranean formations often involves applications and/or procedures employing coatings or plugs. In instances where operations must be conducted at remote locations, namely deep within the earth, equipment and materials can only be manipulated at a distance. One such operation concerns perforating and/or well completion operations incorporating filter cakes and the like as temporary coatings.

Generally, perforating a well involves a special gun that shoots several relatively small holes in the casing. The holes are formed in the side of the casing opposite the producing zone. These perforations, or communication tunnels, pierce the casing or liner and the cement around the casing or liner. The perforations go through the casing and the cement and a short distance into the producing formation. Formations fluids, which include oil and gas, flow through these perforations and into the well.

The most common perforating gun uses shaped charges, similar to those used in armor-piercing shells. A high-speed, high-pressure jet penetrates the steel casing, the cement, and the formation next to the cement. Other perforating methods include bullet perforating, abrasive jetting, or high-pressure fluid jetting.

The characteristics and placement of the communication tunnels can have significant influence on the productivity of the well. Technology has been developed which eliminates the need for perforating guns and enables significantly more controlled perforation through the use of fluid conduits installed within casings. These fluid conduits may be extended out from the casing to contact a formation wall, thereby forming "perforations" at desired locations along the length of the casing. Temporary plugs in the conduits form fluid barriers, and the conduits are pushed out from the casing via fluid pressure. The plugs may be made of a porous filter structure on which a degradable barrier material is coated. After the fluid conduits are extended, the degradable material may be removed, thereby allowing the flow of fluids through the filter structure. This technology, known as TELEPERF™ from Baker Hughes Inc, is described in more detail in U.S. Pat. Nos. 7,527,103 and 7,461,699, each incorporated by reference herein its entirety.

In some instances, it may be necessary or desirable to fracture a formation to enable or promote the flow of fluids therethrough. For example, in low-permeability reservoirs, it may be beneficial to fracture the well formation and inject proppants into the fractures to stimulate the flow of fluids (such as oil, gas, water, and the like) through the formation. When hydraulic fracturing is performed, the viscous fracturing fluids mixed with proppant are flowed into the formation through the casing and associated perforations. However, filters in the above-described TELEPERF™ devices may obstruct or impede the high-viscosity fluids and proppants utilized in hydraulic fracturing from entering the formation.

Accordingly, it may be desirable to temporarily block, fill, or plug the fluid conduits without employing a filter structure in the conduits while still enabling the conduits to telescope outward via fluid pressure.

SUMMARY

There is provided, in one non-limiting form, a method for hydraulic fracturing which includes drilling a wellbore through a subterranean reservoir and positioning a pipe within the wellbore. The pipe has orifices through at least a region of its wall, and flow conduits, pathways, channels, passages, outlets, or the like are situated within the orifices in a retracted position within the pipe. The flow conduits have temporary plugs which block, inhibit, or prevent the flow of fluid through the conduits. The hydraulic fracturing method further involves applying hydraulic pressure to the temporary plugs by pumping an extension fluid into the pipe and the flow conduits. The hydraulic pressure extends the flow conduits radially outward from the pipe in the direction of the wellbore wall. The temporary plugs may then be removed from the flow conduits via an acidic solution. In an exemplary non-limiting embodiment, the extension fluid may be an acidic solution which serves to both extend the flow conduits out from the pipe and to dissolve the temporary plugs. Hydraulic fracturing fluid may then be injected into the subterranean reservoir via the pipe and the flow conduits.

In another non-limiting embodiment of the present disclosure, a plug may be provided for use in a conduit, pathway, channel, passage, or the like that is radially extensible from a pipe. The plug may be made of a material that has an acid solubility greater than 70% and permeability of less than 10 mD. The plug may additionally have a compressive Young's modulus of at least 5,000 MPa. For example, the plug may be made of a natural, low cost material, like Indiana limestone, other natural limestones with similar properties, or another material. In addition, the plug may have a matrix formation that is augmented with nanoparticles disposed within the matrix.

In a further non-limiting embodiment, the present disclosure provides a pipe for use in well completions. The pipe may have flow conduits, pathways, channels, passages, outlets, or the like which provide fluid communication between the interior and the exterior of the pipe. The flow conduits may be at least partially disposed within the pipe and extensible from the pipe in a direction relatively perpendicular to a longitudinal axis of the pipe. Additionally, fluid flow through the flow conduits may be temporarily blocked, inhibited, or prevented by acid-soluble plugs disposed within the flow conduits. In an exemplary embodiment, the acid-soluble plugs may be made of a material having an acid solubility greater than 70%, permeability of less than 10 mD, and/or a compressive Young's modulus of at least 5,000 MPa.

DETAILED DESCRIPTION

In accordance with a present embodiment, an oil well casing or liner may contain pre-formed perforations, or holes, therethrough. Further, installed in each perforation may be a moveable fluid conduit or pathway which enables fluid communication between the interior and the exterior of the casing or liner. Although illustrated as a one-piece pipe which moves relative to the casing or liner, the fluid conduit or pathway may be made up of multiple pieces which move relative to each other. For example, the fluid conduit may be several generally cylindrical conduits arrange coaxially with a limited range of motion relative to each other along the commonly shared axis, e.g. in a telescoping configuration.

The flow conduits or pathways may further contain temporary plugs which inhibit or prevent the flow of fluid through the conduits. The moveable flow conduits or pathways may be telescoped out from the casing or liner into the wellbore annulus via fluid pressure within the casing or liner. That is, as fluid is pumped into the casing, the temporary plugs inhibit the fluid from exiting the casing via the flow conduits. Rather, as the pressure inside the casing increases, the flow conduits are pushed outward from the casing. Optimally, the flow conduits contact the wellbore wall, thereby forming a flow pathway through the annulus from the interior of the casing to the formation. In this manner, the described structure may be used as a completion tubular to avoid using a cementing and perforation process. After the assembly is in place across the producing zone location, the temporary plugs may be dissolved using an acidic solution.

Figure 1:
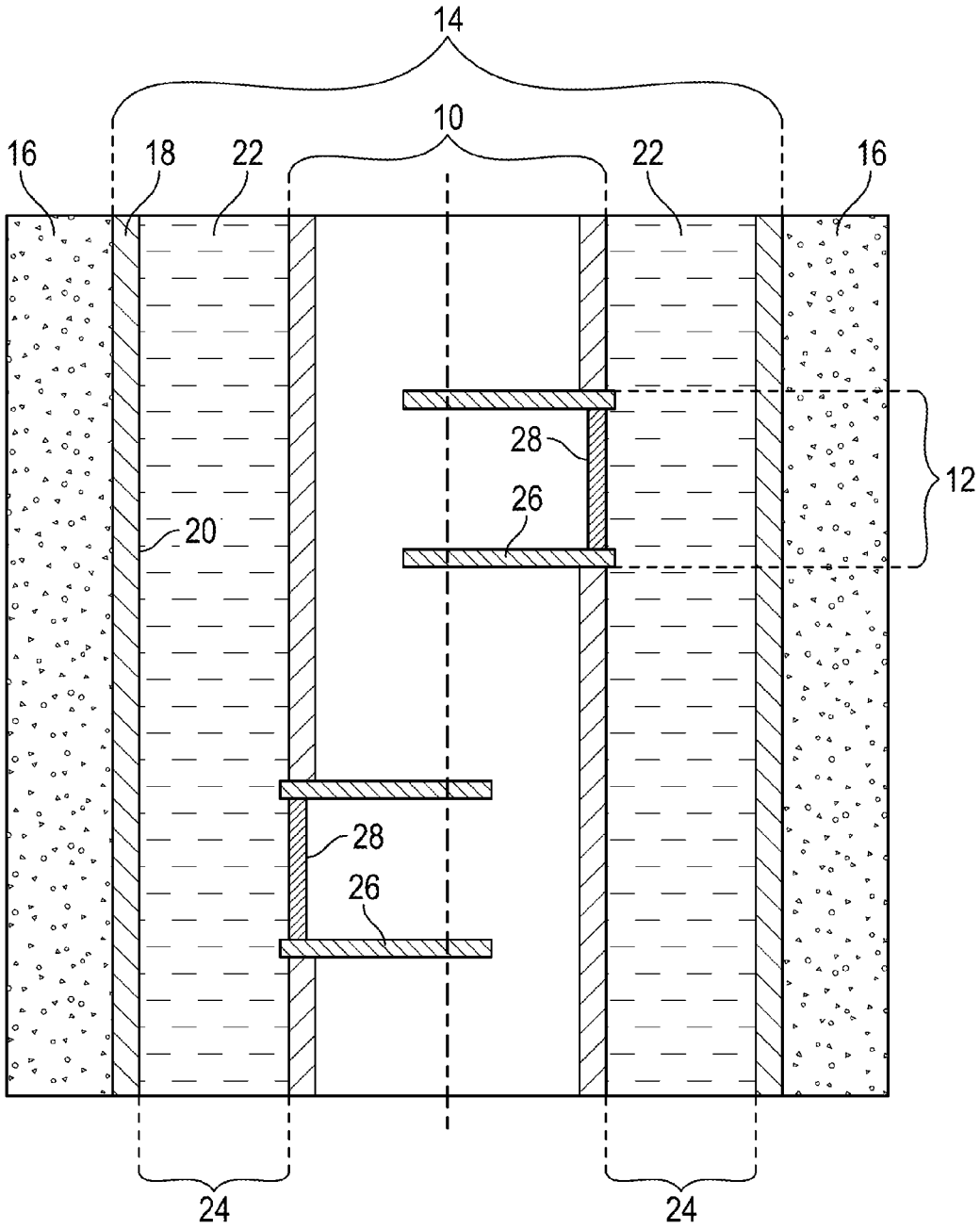
FIG. 1 is a cross-section schematic view of an oil well casing or conduit in a borehole having two sleeves or tubes, one on either side of the casing, each in a retracted position in an orifice in the casing and having a dissolvable plug therein.

The invention will now be described more specifically with respect to the figures, where in FIG. 1 there is shown a cross-section of a vertically oriented, cylindrical casing or liner 10 having multiple orifices 12 therethrough. The orifices 12 may be created by machining or other suitable technique. The casing 10 is placed in a borehole or wellbore 14 through a subterranean reservoir 16. The subterranean reservoir 16 may be a flow source from which gas and/or oil is extracted or, alternatively, a flow target into which gas or water is injected. The wellbore 14 has a wall 18 coated with a filter cake 20 deposited by a drilling fluid or, more commonly, a drill-in fluid 22. In some non-limiting embodiments, the filter cake 20 may be optional. The casing 10 and the wall 18 define an annulus 24 there between.

Fluid conduits 26 are disposed within the orifices 12. These fluid conduits 26 are shown in FIG. 1 in a retracted position within the casing 10. The flow conduits 26 may be generally hollow structures open on opposing ends having an enveloping wall defining their shape. It is expected that in most cases the flow conduits 26 will have a cylindrical shape, but there is no particular requirement that they have such a shape. The fluid conduits 26 contain a temporary plug 28 made of a soluble substance having low permeability and high strength. For example, the plug 28 may have an acid solubility greater than 70% and permeability of less than 10 mD. An exemplary substance is Indiana limestone, which is a relatively inexpensive material that is readily available in the United States and has permeability of less than 3 mD in laboratory studies. Indiana limestone is generally composed of greater than 98% calcite, which has high acid solubility. Additionally, literature data has shown that the compressive Young's modulus of Indiana limestone is approximately 30,600 MPa, which is comparable to high strength concrete. Limestone with similar properties is also easily available in other countries and on other continents. Although the present disclosure refers to the soluble substance of the plugs 28 as limestone, it should be understood that other materials having similar solubility, permeability, and strength may be utilized in the disclosed methods and systems.

In a non-limiting embodiment, the plugs 28 may be pre-formed and secured at an end of the conduits 26 via a threaded hollow cap. In other embodiments, the plugs 28 may be force fit into the conduits 26 or inserted into the conduits 26 and abutted against the inside of a flange (not shown) on an end of the conduit 26. The permeability of the plugs 28 may be further reduced by filling the limestone matrix with another acid-soluble substance, such as a nanoparticle slurry. For example, nanoparticle slurry may be optionally used to fill in the limestone matrix to make the acid-soluble plug 28 tighter, further reducing the permeability of the plug 28. The nanoparticles may have relatively large surface charges per volume, thereby permitting the crystal particles to associate, link, connect, group, or otherwise relate together to further reduce the permeability of the plug 28. Exemplary acid-soluble nanoparticle slurries include, in non-limiting embodiments, ConFINE™, available from Baker Hughes, or a high-concentration slurry of approximately 35 nm magnesium oxide (MgO).

Figure 2:
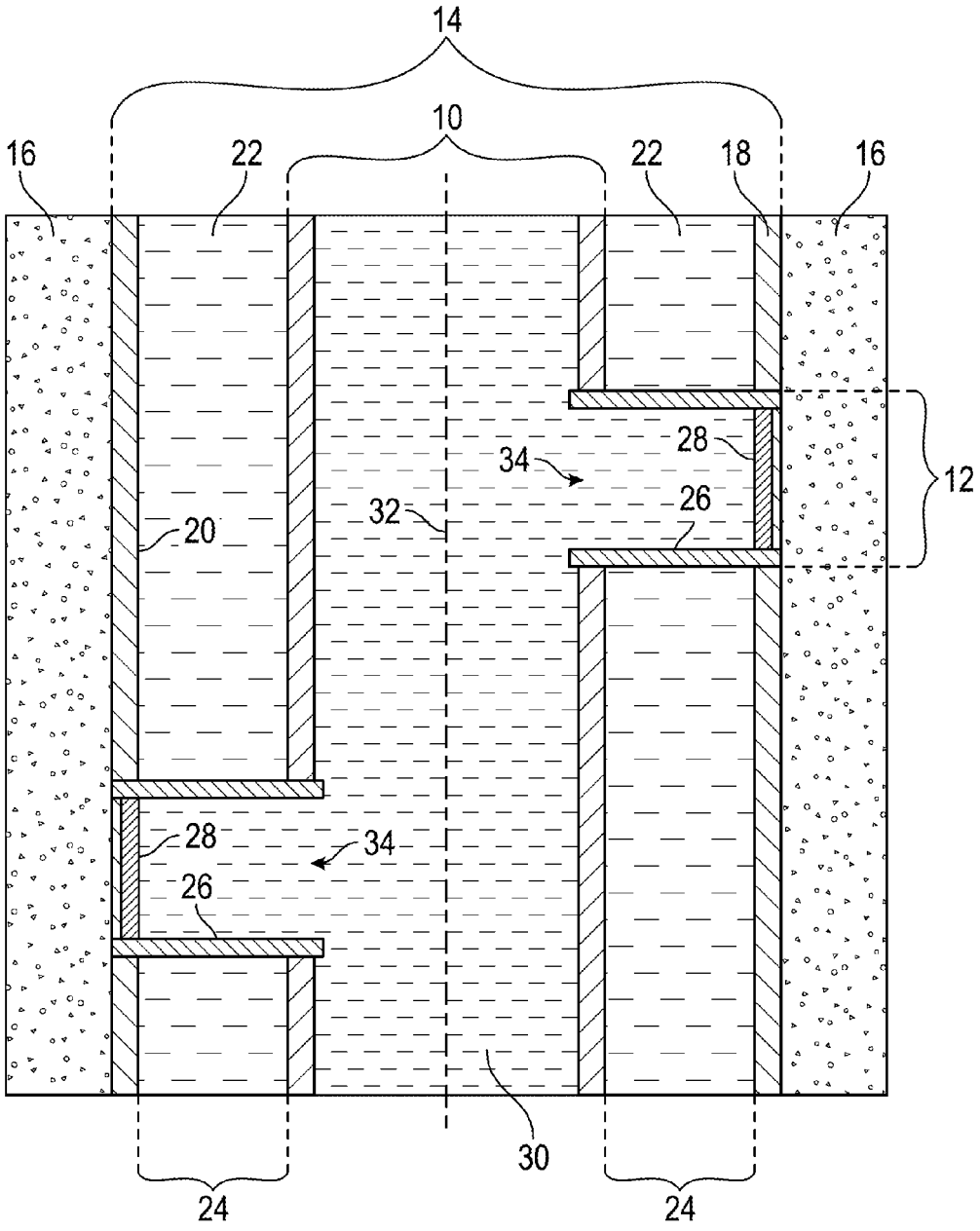
FIG. 2 is a cross-section schematic view of the oil well casing in the wellbore of FIG. 1 having two flow pathways on either side thereof, where the sleeves or tubes have been extended or expanded in the direction of the wellbore wall.

Once the casing 10 is placed or positioned in the wellbore 14, a fluid 30 may be pumped through the casing 10 and the conduits 26, as shown in FIG. 2. As noted above, the plugs 28 within the conduits 26 have a very low permeability; accordingly, the fluid 30 does not flow through the plugs 28 or flows through the plugs 28 very slowly. As the fluid 30 is pumped into the casing 10, high enough hydraulic pressure is built up to radially extend the flow conduits 26 out from the casing 10 into the annulus 24 to contact the producing formation 16. That is, the conduits 26 may be extended out from the casing 10 in a direction generally perpendicular to a longitudinal axis 32 of the casing 10. In a non-limiting embodiment, the conduits 26 may be several generally cylindrical coaxial conduits which telescope outward from the casing 10 as pressure is applied to the plug 28. The hydraulic pressure of the fluid 30 typically causes the conduits 26 to extend to a position in which the conduits 26 touch the wall 18.

Figure 3:
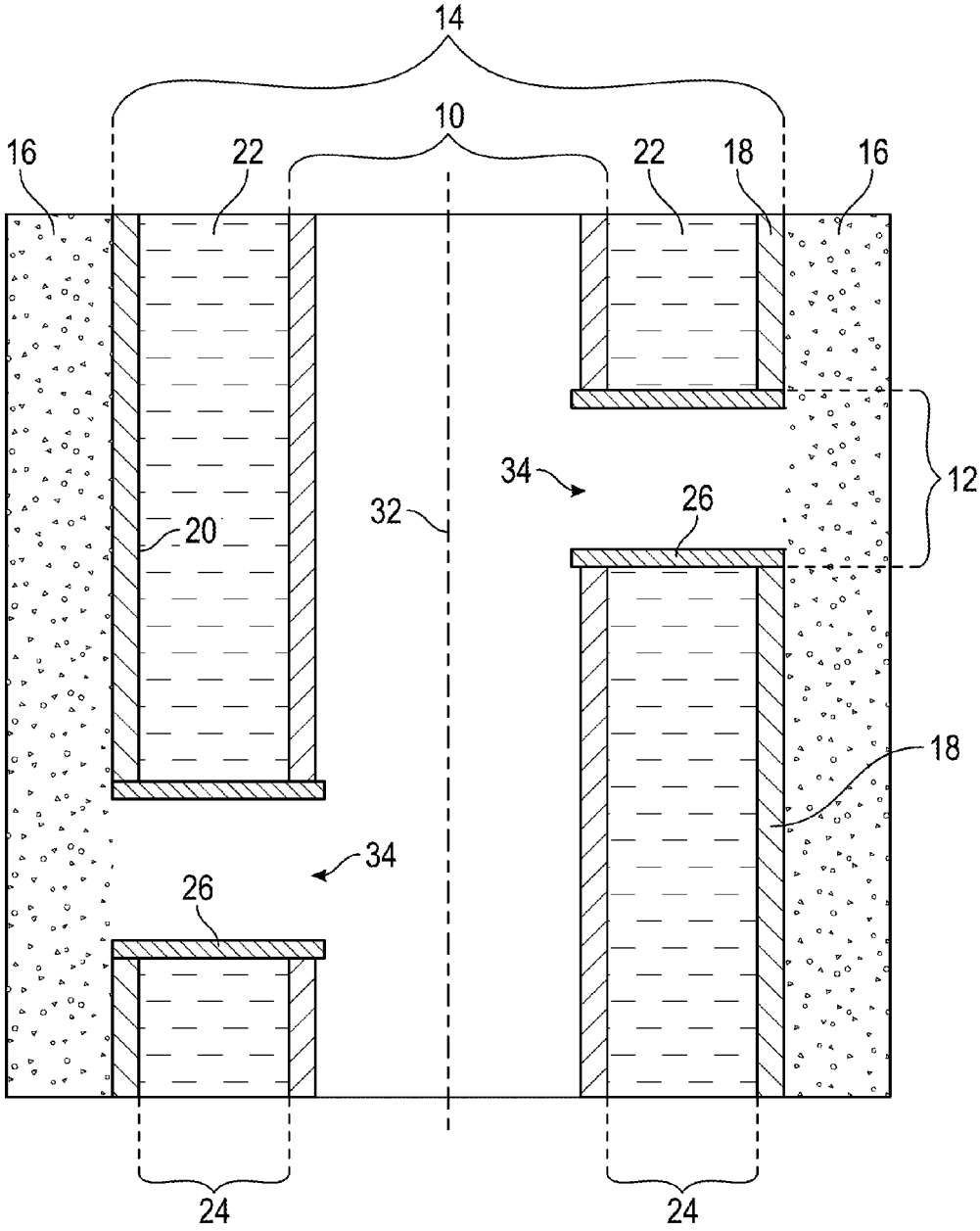
FIG. 3 is a cross-section schematic view of the oil well casing in the wellbore of FIG. 1 where the dissolvable plugs in the flow pathways have been removed, and hydrocarbons may flow from the reservoir into the casing.

An acidic solution may then be pumped into the casing 10 to dissolve the plugs 28, thereby forming flow paths 34 through the annulus 24 between the casing 10 and the formation 16, as shown in FIG. 3. The acidic solution may also dissolve the portions of the filter cake 20 (if present) with which it comes into contact. Fracturing fluids containing proppants may then be flowed through the casing 10 at high pressure to fracture the formation 16 in accordance with techniques well known in the art. Because the limestone plugs 28 may be substantially removed and do not leave behind a porous substrate to act as a filter, the proppants, such as grains of sand or the like, are not hindered from flowing into the fractures (not shown) created in formation 16. After the well is fractured, the well may be produced or injected. For instance, hydrocarbons may flow through the pathways 34 from the formation 16 into the casing 10, or water may be injected into the casing 10, through the flow pathways 34, and into the formation 16.

In a non-limiting embodiment, the fluid 30 used to extend the conduits 26 may also be utilized to dissolve the plugs 28. That is, the fluid 30 may be an acidic solution having a low enough chemical reaction rate with the limestone plugs 28 that the plugs 28 begin slowly dissolving while the hydraulic pressure of the extension fluid 30 pushes the conduits 26 outward toward the wellbore wall 18. After the conduits 26 are extended out to touch the face of the reservoir 16, the acidic fluid 30 may continue to be pumped into the casing 10 to substantially dissolve the plugs 28. It should be understood that the method herein is considered successful if the plugs 28 dissolve sufficiently to open up the flow conduits 26 enough to enable flow of viscous fracturing fluids and proppants therethrough.

An exemplary acidic solution for use as the extension and dissolving fluid 30 may be a dicarboxylic acid, as described in U.S. Pat. No. 6,805,198, incorporated by reference herein in its entirety. Dicarboxylic acid, also known as HTO (high temperature organic) acid, has a very low corrosion rate on metal components used in well production, such as tubing, casing, and downhole equipment. Exemplary dicarboxylic acids include, but are not necessarily limited to, oxalic acid (ethanedioic acid), malonic acid (propanedioic acid), succinic acid (butanedioic acid), glutaric acid (pentanedioic acid), adipic acid (hexanedioic acid), pimelic acid (heptanedioic acid), and mixtures thereof. In a non-limiting embodiment, the extension and dissolving fluid 30 may be dibasic acid composed of 51-61 weight percent glutaric acid, 18-28 weight percent succinic acid, and 15-25 weight percent adipic acid. Suitable solvents or diluents for the acidic fluid 30 may include, but are not limited to, water, methanol, isopropyl alcohol, alcohol ethers, aromatic solvents, and mixtures thereof. Laboratory tests show that the solubility of Indiana limestone in 10 weight percent HTO acid is about 98.86 percent. Accordingly, given enough time to contact all of the limestone plugs 28, essentially all of the acid-soluble plugs 28 will be removed.

In another non-limiting embodiment, a stronger acid, such as, for example, 15 weight percent hydrochloric acid (HCl), may be pumped into the casing 10 to dissolve the plugs 28 more quickly after the conduits 26 are extended out to touch the face of the reservoir 16. Laboratory tests show that the solubility of Indiana limestone in 15 weight percent HCl is about 99.01 percent. Further exemplary acids which may be used in the present disclosure include, but are not limited to, sulfuric acid ($H_2SO_4$), hydrofluoric acid (HF), formic acid (HCOOH), acetic acid ($CH_3COOH$), fluoroboric acid ($HBF_4$), phosphoric acid ($H_3PO_4$), citric acid, sulfonic acid, glycolic acid, and other acids. In addition, the plugs 28 may be dissolved with chelating agents, such as, for example, ethylenediaminetetraacetic acid (EDTA), disodium EDTA ($Na_2EDTA$), hydroxyethylethylenediaminetriacetic acid (HEDTA), docosatetraenoic acid (DTA), nitrilotriacetic acid (NTA), hydroxyaminopolycarboxylic acid (HACA), diethylenetriaminepentaacetic acid (DTPA), hydroxyethyliminodiacetic acid (HEIDA), polyaspartic acid (PASP), and the like.

CONCLUSION

It will be evident that various modifications and changes may be made to the foregoing specification without departing from the broader spirit or scope of the invention as set forth in the appended claims. Accordingly, the specification is to be regarded in an illustrative rather than a restrictive sense. For example, specific materials, fluids, acidic solutions, and combinations thereof falling within the claimed parameters, but not specifically identified or tried in a particular composition, are anticipated to be within the scope of this invention. Additionally, various components and methods not specifically described herein may still be encompassed by the following claims.

The words "comprising" and "comprises" as used throughout the claims is to be interpreted as "including but not limited to". The present invention may suitably comprise, consist of, or consist essentially of the elements disclosed and may be practiced in the absence of an element not disclosed. For example, in one non-limiting embodiment, a pipe used in well completions may consist of or alternatively consist essentially of an interior space, an outer surface, at least one flow conduit and an acid-soluble plug disposed within the flow conduit, as described in the claims.

The invention claimed is:

1. A method for hydraulic fracturing within a subterranean reservoir, wherein the subterranean reservoir has a wellbore therethrough, and the wellbore has positioned within it a pipe comprising:

an interior space;

an outer surface; and at least one flow conduit between the interior space and the outer surface, where the flow conduit bears within it an acid-soluble plug comprising a limestone plug and a nanoparticle slurry, and the flow conduit is in a retracted position at least partially within the interior space;

the method comprising:

applying hydraulic pressure via an extension fluid within the interior space of the pipe and the flow conduit to extend the flow conduit in the direction of a wall of the wellbore; wherein the extension fluid is an acidic solution that simultaneously extends out and dissolves the acid-soluble plug to at least partially open the flow conduit, wherein the dissolved acid-soluble plug does not leave behind a porous substrate;

injecting a fracturing fluid into the subterranean reservoir via the interior space of the pipe and the flow conduit; and wherein the method is performed in the absence of a cementing process.

2. The method of claim 1, wherein the acid-soluble plug comprises a material having an acid solubility greater than 70% and permeability of less than 10 mD.

3. The method of claim 1, wherein the extension fluid comprises a dicarboxylic acid.

4. The method of claim 3, wherein the dicarboxylic acid is selected from the group consisting of oxalic acid, malonic acid, succinic acid, glutaric acid, adipic acid, pimelic acid, and mixtures thereof.

5. The method of claim 1, wherein the extension fluid comprises a dibasic acid.

6. The method of claim 1, wherein the acidic solution comprises hydrochloric acid, sulfuric acid, hydrofluoric acid, formic acid, acetic acid, fluoroboric acid, phosphoric acid, citric acid, sulfonic acid, glycolic acid, ethylenediaminetetriacetic acid (EDTA), disodium EDTA ($Na_2EDTA$), hydroxyethylethylenediaminetriacetic acid, docosatetraenoic acid, nitrilotriacetic acid, hydroxyaminocarboxylic acid, diethylenetriaminepentaacetic acid, hydroxyethyliminodaicetic acid, polyaspartic acid, or a combination thereof.

7. The method of claim 1, wherein the pipe is selected from the group consisting of conductor pipe, casing, tubing, liner, and combinations thereof.

8. The method of claim 1, wherein the fracturing fluid comprises one or more proppant materials.

9. A pipe for use in well completions, comprising:

an interior space;

an outer surface;

at least one flow conduit between the interior space and the outer surface, where the flow conduit is radially moveable relative to a longitudinal axis of the pipe and is in a retracted position at least partially within the interior space;

an acid-soluble plug disposed within the flow conduit, where the acid-soluble plug comprises a limestone plug and a nanoparticle slurry, and wherein the acid-soluble plug is substantially removable and does not leave behind a porous substrate upon removal of the acid-soluble plug; and wherein the pipe is configured to be usable in the absence of a cementing process; and wherein the flow conduit is configured to be extended outward by an acidic fluid that simultaneously pushes out and dissolves the acid-soluble plug disposed in the flow conduit.

10. The pipe of claim 9, wherein the pipe is selected from the group consisting of conductor pipe, casing, tubing, liner, and combinations thereof.

11. The pipe of claim 9, wherein the material has a compressive Young's modulus of at least 5,000 MPa.

* * * * *